US009565912B2

(12) United States Patent
Fatscher

(10) Patent No.: US 9,565,912 B2
(45) Date of Patent: Feb. 14, 2017

(54) CEMENT FINISHING TOOL COVER

(76) Inventor: Edward Fatscher, East Northport, NY (US)

( * ) Notice: Subject to any disclaimer, the term of this patent is extended or adjusted under 35 U.S.C. 154(b) by 130 days.

(21) Appl. No.: 13/135,993

(22) Filed: Jul. 20, 2011

(65) Prior Publication Data

US 2012/0018328 A1 Jan. 26, 2012

Related U.S. Application Data

(60) Provisional application No. 61/400,028, filed on Jul. 22, 2010.

(51) Int. Cl.

| | |
|---|---|
| ***B65D 83/10*** | (2006.01) |
| ***A45D 44/18*** | (2006.01) |
| ***A45C 11/26*** | (2006.01) |
| ***A45C 13/00*** | (2006.01) |

(52) U.S. Cl.

CPC ..... *A45C 13/002* (2013.01)

(58) Field of Classification Search

CPC .... A45D 44/18; A45D 34/045; A45D 34/046; A47K 1/09; A46B 2200/1066; A46B 17/04; A46B 2200/202; B65D 51/32; B44D 3/125

USPC ..... 206/472, 362.3, 361, 349; 151/161, 154

See application file for complete search history.

(56) References Cited

U.S. PATENT DOCUMENTS

| | | | | |
|---|---|---|---|---|
| 1,951,576 | A * | 3/1934 | Lehr | 206/361 |
| 2,051,267 | A * | 8/1936 | Mezey | 206/361 |
| 2,654,504 | A * | 10/1953 | Hyams | B44D 3/125 206/209 |
| 4,606,456 | A * | 8/1986 | Kaminski | 206/362.4 |
| 4,730,680 | A * | 3/1988 | Indzeoski | 172/375 |
| 5,465,453 | A * | 11/1995 | Landmeier | A46B 17/04 15/247 |
| 5,502,859 | A * | 4/1996 | Kim | A46B 5/0075 15/144.1 |
| 5,593,025 | A * | 1/1997 | Feibelman | A47F 7/02 206/495 |
| 6,199,694 | B1 * | 3/2001 | Van Diest et al. | 206/361 |
| 6,390,430 | B1 * | 5/2002 | Hawley | B44D 3/123 206/15.2 |
| 6,499,519 | B1 * | 12/2002 | Brown | D06F 75/38 150/161 |
| 6,575,295 | B2 * | 6/2003 | Mayfield | 206/15.3 |
| 8,074,796 | B1 * | 12/2011 | Andrews | 206/361 |
| 8,091,701 | B1 * | 1/2012 | DePietro | 206/15.3 |
| 2004/0050732 | A1 * | 3/2004 | Baker | 206/361 |
| 2008/0073237 | A1 * | 3/2008 | Jackson | 206/457 |

(Continued)

*Primary Examiner* — Anthony Stashick
*Assistant Examiner* — Kaushikkumar Desai
(74) *Attorney, Agent, or Firm* — Sorell, Lenna & Schmidt, LLP

(57) ABSTRACT

Cement finishing tool cover is provided that is configured to cover a cement-finishing tool having a bundle of fibers affixed to a frame at one. The case having a pair of spaced opposite substantially parallel face panels having an inside surface and an outside surface. At least one of said inside surface of the pair of spaced opposite substantially parallel face panels is equipped with a hanging element that is designed to engage at least portion of the frame of the cement finishing tool so as to prevent the bundle of fibers from coming in contact with a surface when the case is placed on a surface. This protects the fibers from becoming disfigured and adversely affecting the finishing of a cement surface when used.

20 Claims, 8 Drawing Sheets

(56) References Cited

U.S. PATENT DOCUMENTS

| | | | | |
|---|---|---|---|---|
| 2010/0276318 | A1* | 11/2010 | Gabbard | A46B 17/04<br>206/361 |
| 2011/0138557 | A1* | 6/2011 | Herrmann | A43B 3/163<br>15/160 |

* cited by examiner

CEMENT FINISHING TOOL COVER

CROSS REFERENCE TO RELATED APPLICATIONS

This application claims priority to U.S. provisional application No. 61/400,028 filed Jul. 22, 2010, which is herein incorporated in its entirety by reference

FIELD OF THE INVENTION

The present invention relates to a cover for cement finishing tools and more particularly pertains to a cover specifically designed to protect the bristles of a finishing tool used for finishing cement surfaces.

BACKGROUND OF THE INVENTION

When completing a cement surface arguably the most important part is the finishing of the surface. A cement walkway with a poor finish, although functional, is often regarded as poor work by the homeowner or landowner requesting the job. One way used by almost all masonry workers is the use of cement finishing tools such as fine bristle brooms that are used to smooth out the surface to provide a clean surface that is pleasing to the customer's eye. In order to get a clean, uniform surface, the finishing tools used must have a clean, uniform bristle surface so as not to reflect the imperfections in the bristle head in the surface face it is being used create. The cost of a good quality cement-finishing tool could be $100 dollars or more and is designed for multiple jobs as long as the bristles are properly cleaned and protected from damage.

In addition, when on a job time and money is wasted when the finishing tool is removed from the truck and it has bent/deformed bristles form being thrown in the back of the truck. The head of the finishing tool that has bristles can be removed for storage. If the finishing tool's head were stored on an uneven surface, the sheer weight of the head itself would cause the bristles to become disfigured and most likely stay that way. This makes the tool unusable for its intended purpose. That is if the tool is used in this condition the uneven bristles will create marks/lines/uneven tracks in the cement that is considered to be a poor finish.

Often, it is first realized that the finishing tool used to finish the surface of the cement is defective at the end of the job when it is time to use the tool to finish the surface. At this time, if the cement is already poured, there is no time to get another finishing tool and the defective one must be utilized. This leads to a poor finish and extra work to try to make the surface look as good as possible. Not to mention adding an addition cost to the job to replace the finishing tool for the next job.

Accordingly, it is very important that the cement-finishing tool utilized for smoothing concrete surfaces is stored carefully so as to not damage the bristles. However, since these tools are often stored in a work trucks, even storing the bristled heads with care cannot prevent shifting of tools when in transit which usually cause damage to the bristles and therefore rendering the finishing tool unusable. Even if the bristles are covered for protection, the finishing tools own weight will damage the bristles in transit.

Therefore, what is needed is a cover specifically designed to not only protect the bristles of the cement finishing tools from being damaged from other objects stored along side the tools, but to protect the bristles from becoming damaged when stored. The cover must also be made to fit finishing heads made from different manufactures and be configured to allow air to circulate about the bristles, since the bristles are often stored wet after cleaning. The present invention is configured to address the problems in the field today.

SUMMARY OF THE INVENTION

The present invention is directed to a cement finishing tool cover configured to enclose at least part of a cement finishing tool having a bundle of fibers affixed to a frame at one end thereof. The cement finishing tool cover comprising front and back substantially parallel spaced apart face panels configured to form an enclosure for the cement finishing tool. The front and back face panels having an inside surface and an outside surface wherein at least one of the inside surfaces further comprises a hanging element that is configured to engage at least portion of the frame of the cement finishing tool. Once the frame engages the hanging element, it suspends the cement finishing tool inside the cover and prevents the bundle of fibers from protruding out of a bottom portion. That is, the cover secures and suspends the cement finishing tool inside the enclosure of the cover/case thus preventing the fibers from contacting a surface and becoming damaged. Since it is important that the fibers of the tool remain straight and in good condition in order to provide a quality finish to a cement surface, it is important to protect the fibers from becoming bent when stored. The cover of the present invention achieves just that saving money and time in the cement construction business.

In one embodiment of the present invention a cement finishing tool cover configured to cover a cement finishing tool having a bundle of fibers affixed to a frame at one end thereof and at least one bore in said frame is provided. This structure resembles the first embodiment summarized above having front and back substantially parallel spaced apart face panels that are configured to form an enclosure for the cement finishing tool. The front and back face panels have an inside surface and an outside surface and at least one of the inside surfaces of the face panels comprises at least one peg-like extension that is configured to mate with at least one bore so as to secure the cement finishing tool to the cover. This prevents the tool when thrown in the back of a truck or tool bag from becoming damaged and thereby saving time and money for the cement technician.

Also provided as part of the present invention is a kit comprising at least one cement finishing tool and at least one cement finishing tool cover according to the present invention. The kit may also include extension poles, additional sized cement finishing tools and covers as well as other items necessary to work with and complete a cement surfacing project.

The present invention is also directed to a method of storing a cement finishing tool using at least one of the covers provided as part of the present invention. The present invention and how it is used is further described in the detailed description and figures provided herein.

DETAILED DESCRIPTION OF THE INVENTION

Figure 1:
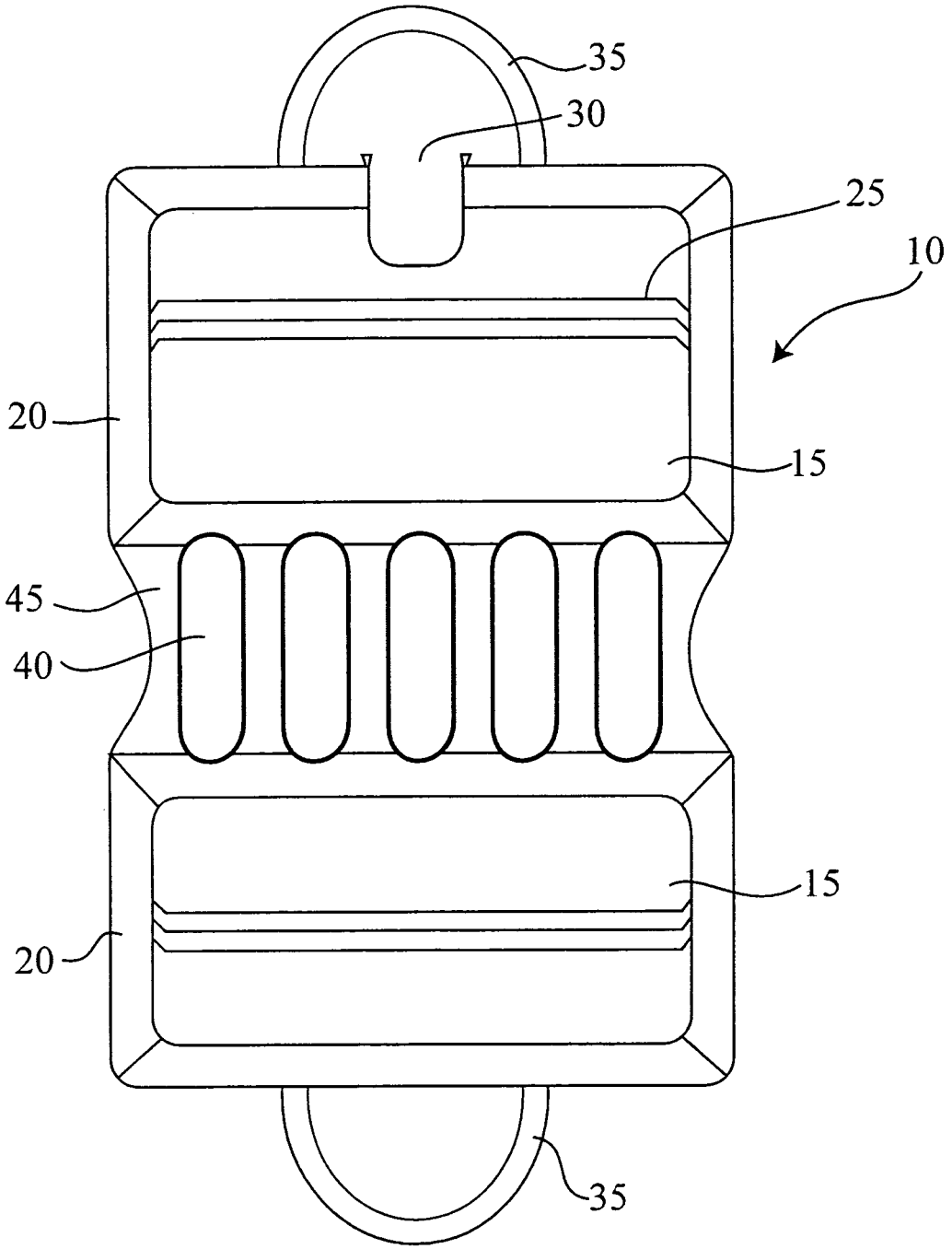
FIG. 1 shows a perspective view of a one-piece cover having hanging elements in an open position.

The present invention may be understood more readily by reference to the following detailed description of the invention taken in connection with the accompanying drawing figures, which form a part of this disclosure and in which like numbers indicate like features. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value.

When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior". As used herein, "comprising", containing", "characterized by" and grammatical equivalents thereof are inclusive or open-ended terms that do not exclude additional, non-recited elements or method steps, but will also be understood to include the more restrictive terms "consisting of" and "consisting essentially of."

The present invention is directed to cement finishing tool cover configured to cover a cement finishing tool having a bundle of fibers affixed to a frame at one end thereof. The cement finishing tool cover comprising a case configured to cover the bundle of fibers affixed to one end of the frame so as to prevent any bending, crunching, disfigurement or loss of fibers from the finishing tool. The case comprising a pair of spaced opposite substantially parallel face panels having an inside surface and an outside surface wherein at least one of the inside surfaces of the face panels further comprises a hanging element that is configured to engage at least part of the frame of the cement finishing tool. This prevents the bundle of fibers of the cement-finishing tool from contacting a surface when the tool is positioned in the case and the case is placed on a surface.

Many different designs of the hanging tools are possible but all must serve the function of preventing the bristles from touching the surface on which it is placed. This protects the integrity and form of the bristles so as to extend the useable life span of the cement-finishing tool. Tools that have deformed bristles must be discarded since the deformity will be reflected in the finish of the cement surface and render the job unacceptable.

In one embodiment of the present invention the cement finishing tool cover is configured to open so as to allow the cement finishing tool to be placed into the case in such away as to come in contact with a hanging element positioned on the inner surfaces of the case. The hanging element is configured to suspend the cement tool in place. This assures that the bundle of fibers of the cement-finishing tool will remain elevated from the lower edge of the case so that when the case is placed on the floor the fibers are prevented form coming in contact with the floor. This protects the integrity of the fibers of the cement-finishing tool.

In yet another embodiment of the present invention the hanging element cement finishing tool cover is configured to have a ridge that extends away from at least one of the inside surfaces of a pair of spaced opposite substantially parallel face panels. The distance in which the ridge extends is less than the width of the case when closed so that the frame of a cement-finishing tool placed therein rests on the ridge and the cement-finishing tool is suspended there from. In this position, the frame rests on the ridge and the bundle of fibers extend unobstructed there through in an elevated orientation so that the fibers remain elevated from the lower edge of the case and do not contact the floor when the case is placed on the floor. This protects the integrity of the fibers of the cement-finishing tool.

In yet another embodiment of the present invention the cement finishing tool case further comprises a substantially circular open upper end in the form of a neck for accommodating a broomstick and a substantially elongated rectangular open lower end for accommodating the bundle of fibers. This embodiment as with all of the described embodiments are configured to have a hanging element to assure that the bundle of bristles are protected from contact with the floor, other surfaces or even other tools thrown in the back of truck during transportation.

Still yet another embodiment of the present invention is directed to a cement finishing tool cover wherein the hanging element is at least one bolt-like extension that is designed to fit within at least one matting bore in the frame of the cement-finishing tool. This assures that the fibers of the cement finishing tool remains elevated and protected from contacting a surface when the case is stored.

All of the embodiments described herein should contain drainage/drying holes either at the bottom edge of the case or on the parallel faces so as allow for proper drainage and drying so as to prevent molds. This is an important feature since cement-finishing tools must be thoroughly cleaned before storage, they are often stored wet and therefore the drainage/drying holes allow for drying while being stored.

The present invention is also directed to kits containing the case and multiple cement finishing tools and extension polls. The present invention is also related to methods of finishing a cement surface using a cement finishing tool stored in a cover described herein. Finally, the present invention is also directed to a method of storing a cement-finishing tool using the cover of the present invention.

The features of the present invention, together with other objects and advantages which will become subsequently apparent, reside in the details of construction and operation as more fully hereinafter described and claimed, reference being had to the accompanying drawings forming a part hereof, wherein like numerals refer to like parts throughout.

The following discussion includes a description of the cement finishing tool cover of the present invention, related components and exemplary methods of employing the cover in accordance with the principles of the present disclosure. More particularly, the exemplary embodiments of the cement finishing tool cover of the present invention are particularly suitable for use in the field, storage in the supply store, and can be used to display the finishing tool in the store. Additional embodiments are also disclosed. Reference will now be made in detail to the exemplary embodiments of the present disclosure, which are illustrated in the accompanying figures.

One embodiment of the present invention is described in conjunction with FIG. 1. FIG. 1 shows a one-piece cement finishing tool cover 10 having a pair of spaced opposite substantially parallel face panels 15. The face panels 15 have an inside surface and an outside surface. Attached to the inside surface of at least one of the face panels 15 is a hanging element 25 configured to engage at least part of a frame so as to prevent fibers of a cement finishing tool hung on the hanging element 25 from contacting a surface of which it is placed. The cover can be made as a single unit with two halves connected by a hinge portion that close onto to each other to protect the cement-finishing tool placed therein. It is also envisioned that the cover can be two pieces and assembled in such away as to protect the tool placed inside, especially the fibers of the finishing tool. The front panels can be equipped with sides so as to form a complete enclosure once closed.

The one-piece cover 10 shown in FIG. 1 further comprises drain slots 40 in a bottom portion of the device that are spaced apart from one another by attachment pieces 45. Although multiple drain slots are shown, a single drain slots can be used with this device since either arrangement allows for proper drainage of a wet tool. The attachment pieces 45 also act as multiple hinge portions that allow the two faces to open and close upon each other which still remaining attached to one another. That is, attachment pieces 45 are designed to hold the two halves of the one-piece embodiment together and perform as a hinge that allows the two halves of the device to come together as a single unit. As mentioned above, the two halves of the cover can have side panels 20 that when closed define the thickness of the cover when closed. The dimensions and shape of the cover are configured to fit the most common sized cement finishing tools. That is, the length of the cover must be long enough to protect the fibers, especially the fiber ends, from protruding from the bottom of the device in order to prevent contact and disfigurement of these fibers when the unit is stored.

The cover can be equipped with a neck hole opening 30 configured to accommodate cement finishing tools having raised necks that are used to attach an extension pole to the frame. In the alternative, the neck hole can be used so that the tool can be stored with the extension poll still attached. The cover can be equipped with a handle 35 for easy carrying. The outside surfaces can be inscribed with a company name and/or other logos as seen appropriate to brand the cover.

Figure 1A:
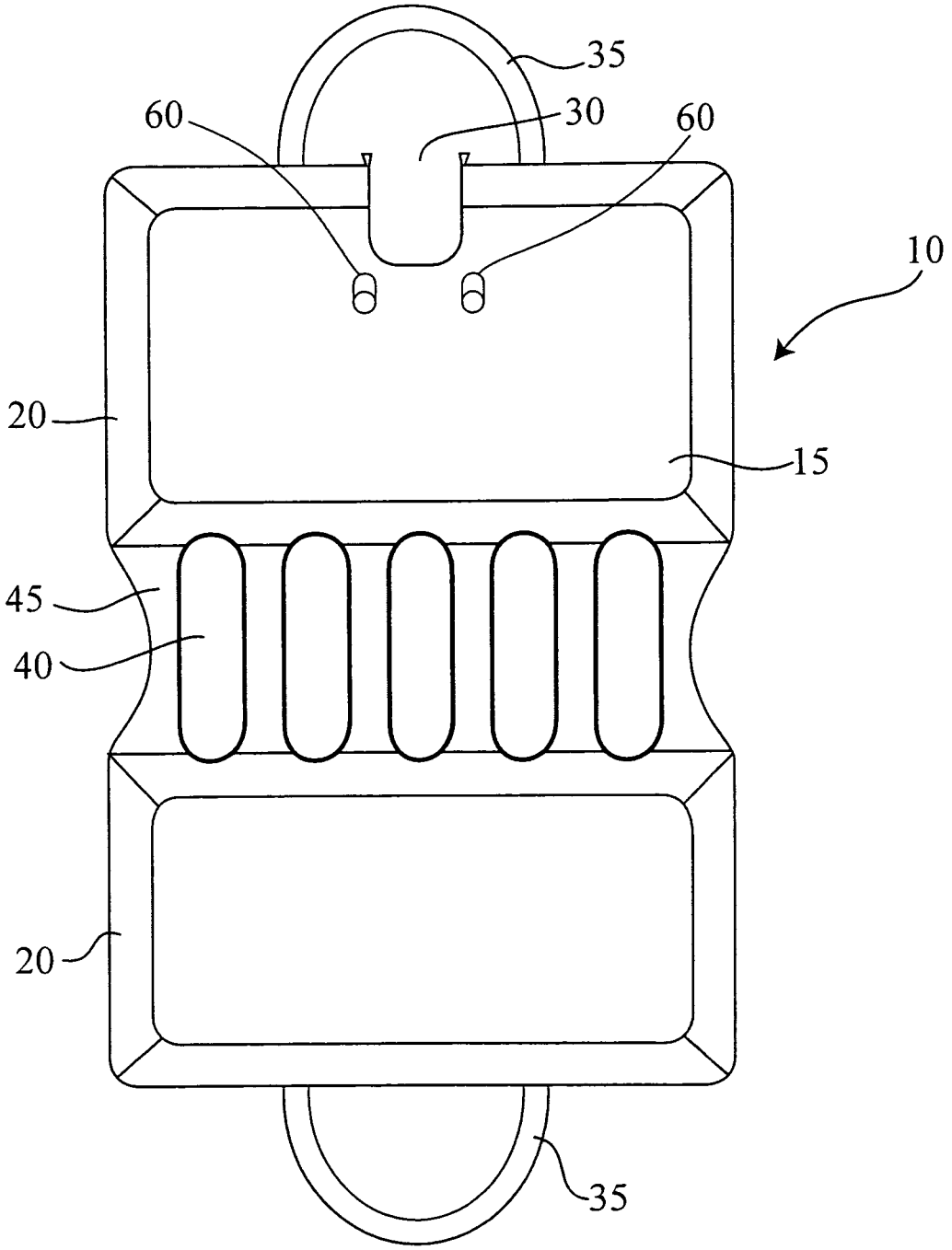
FIG. 1A shows a perspective view of a one-piece cover having hanging elements in an open position having hanging peg-like extensions.

FIG. 1A shows the cover for a cement-finishing tool of FIG. 1 except the hanging element 25 configured to engage at least part of a frame so as to prevent fibers of a cement finishing tool hung on the hanging element 25 from contacting a surface of which it is placed is replaced with at least one peg-like extension. The at least one peg-like extension 25 is configured to mate with at least one bore/hole in the frame of tool (shown in FIG. 2). The mating of the peg-like extension with the bore on the frame of the cement finishing tool secures the cement finishing tool to the cover and prevents damage of the tool when stored. In one embodiment, the peg-like extension is threaded and a complementary threaded nut designed for quick release, i.e. a wing nut, is provided. Other means can be used to secure the tool to the cover and are contemplated to fall within the scope of the invention.

Figure 2:
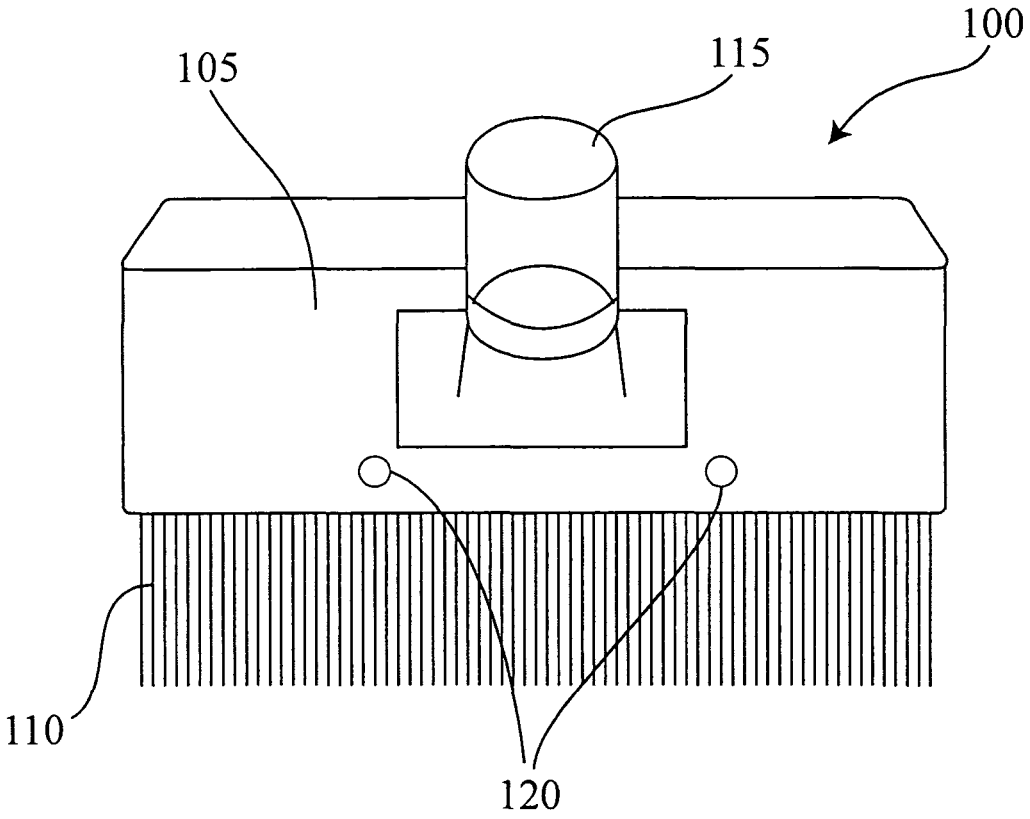
FIG. 2 shows a perspective view of a tool having hanging holes that mate with the hanging elements in FIG. 1.
Figure 3:
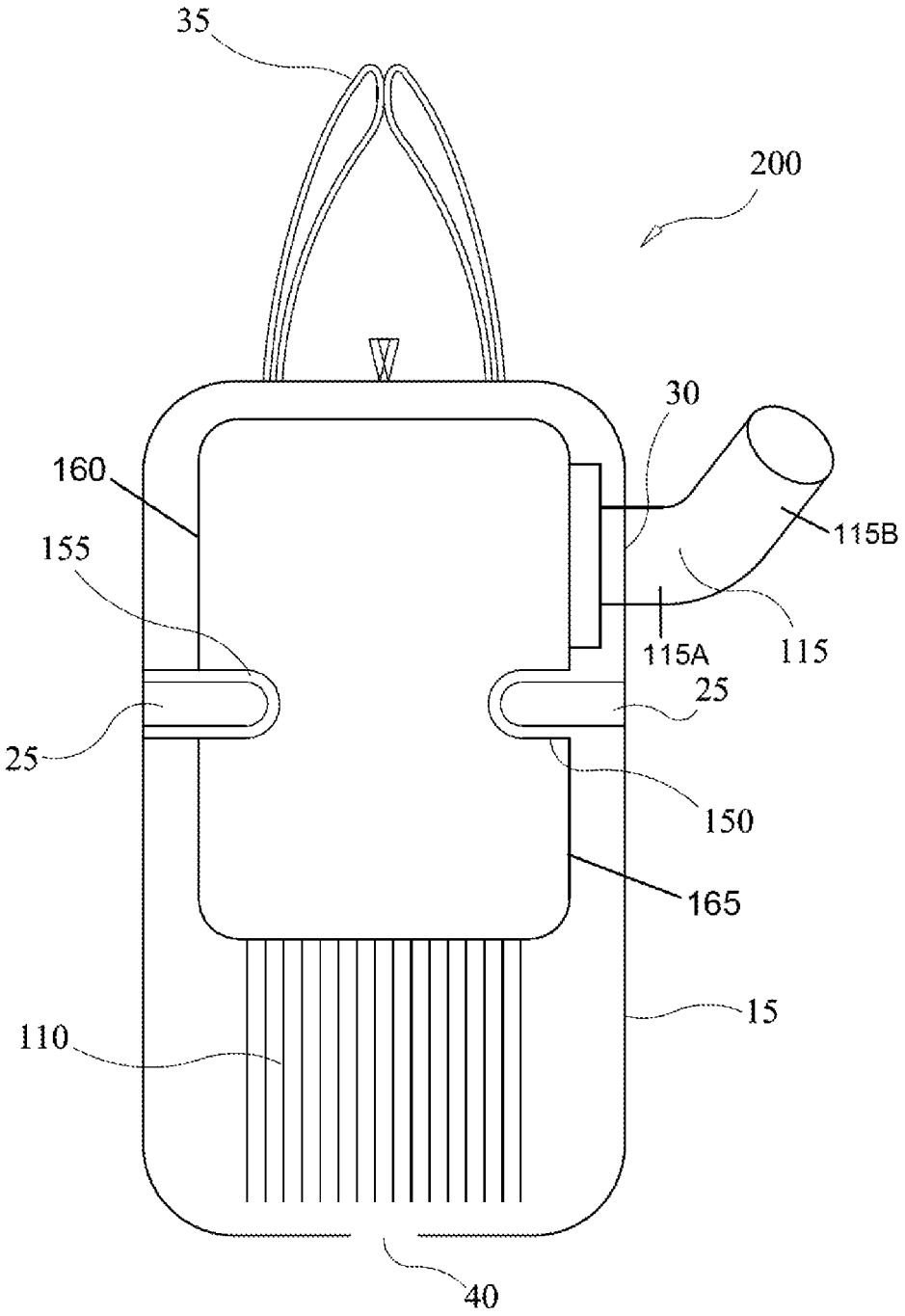
FIG. 3 is a partial cut away cross-sectional view of the tool hanging on the hanging elements in a closed position.

FIG. 2 shows the head of a cement-finishing tool 100 having a frame 105 and fibers 110. The frame is equipped with hanging bores/holes 120 that are complementary to the hanging elements of the cover 10. The tool 100 can be positioned on the hanging element 25 (shown in FIG. 1A) and the cover closed as shown in FIG. 3. The frame 105 shown in FIG. 2 has a neck 115 designed for the extension pole. This allows a cement-finishing tool to be stored with or without the extension pole.

Figure 2A:
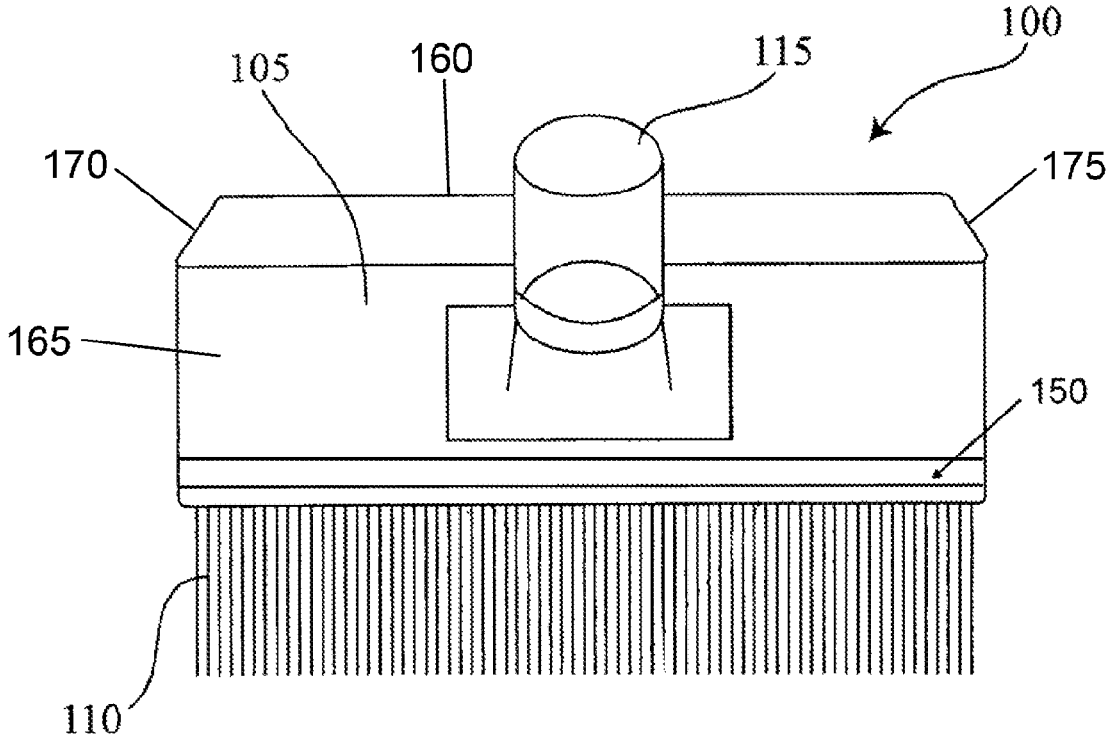
FIG. 2A is perspective view of one embodiment of cement finishing tool 100 in accordance with the principles of the present disclosure.

In one embodiment, in accordance with the principles of the present disclosure, frame 105 of cement finishing tool 100 includes a first aperture 150 on one side of frame 105 (FIG. 2A) and a second aperture 155 on another side of frame 105 (FIGS. 2A and 3). That is, aperture 150 extends into a front wall, such as, for example, a front panel or a front face panel 165 and aperture 155 extends into a back wall, such as, for example, a back panel or back face panel 160. In some embodiments, aperture 150 extends into panel 165 without extending through panel 160 and aperture 155 extends into panel 160 without extending through panel 165, as shown in FIG. 3. In some embodiments, panel 160 is opposite panel 165 such that panel 160 faces away from panel 165. An extension, such as, for example, neck 115 projects outwardly from panel 165. Neck 115 comprises a first portion 115A extending transverse to fibers 110 and a second portion 115B extending from portion 115A. In some embodiments, portion 115A extends perpendicular to fibers 110. In some embodiments, portion 115B extends transverse to portion 115A. In some embodiments, portion 115B extends at an acute angle relative to portion 115A. Portion 115B comprises an opening configured to accommodate an elongated handle. Panels 160, 165 are joined or connected to one another by a first side wall, such as, for example, a first side panel or side face panel 170 and a second side wall, such as, for example, a second side panel or second side face panel 175. In some embodiments, panel 170 is opposite panel 175 such that panel 170 faces away from panel 175. First aperture 150 and second aperture 155 are each configured for disposal of one of hanging elements 25 shown in FIG. 1. As shown in FIG. 3, frame 105 and fibers 110 are positioned within the tool cover 10 shown in FIG. 1. The hanging element 25 that extends from one of face panels 15 of tool cover 10 is positioned within aperture 150 of cement finishing tool 100 and the hanging element 25 that extends from the other one of face panels 15 of tool cover 10 is positioned within aperture 155 of cement finishing tool 100. Apertures 150, 155 of cement finishing tool 100 each extend transverse to fibers 110. That is, apertures 150, 155 each extend into frame 105 such that apertures 150, 155 each intersect a longitudinal axis defined by at least one of fibers 110. The hanging element 25 that extends from one of face panels 15 of tool cover 10 and the hanging element 25 that extends from the other one of face panels 15 of tool cover 10 each define a projection. The projections extend into apertures 150, 155 of cement finishing tool 100 such that cement finishing tool 100 is suspended in cover 10 in a manner in which fibers 110 are prevented from contacting attachment pieces 45 of tool cover 10 and/or extending through drain slots 40 of tool cover 10, as shown in FIG. 3.

As shown in FIG. 3, the two portions of the handle 35 are snapped together and the cover is closed. At the top of the cover 10 is an opening 30 to accommodate either neck of the frame 115 and/or an extension pole if attached. Finally, at the bottom of the cover are drain slots 40 that are designed to allow wet fibers to drain, dry and prevent mold.

Figure 4:
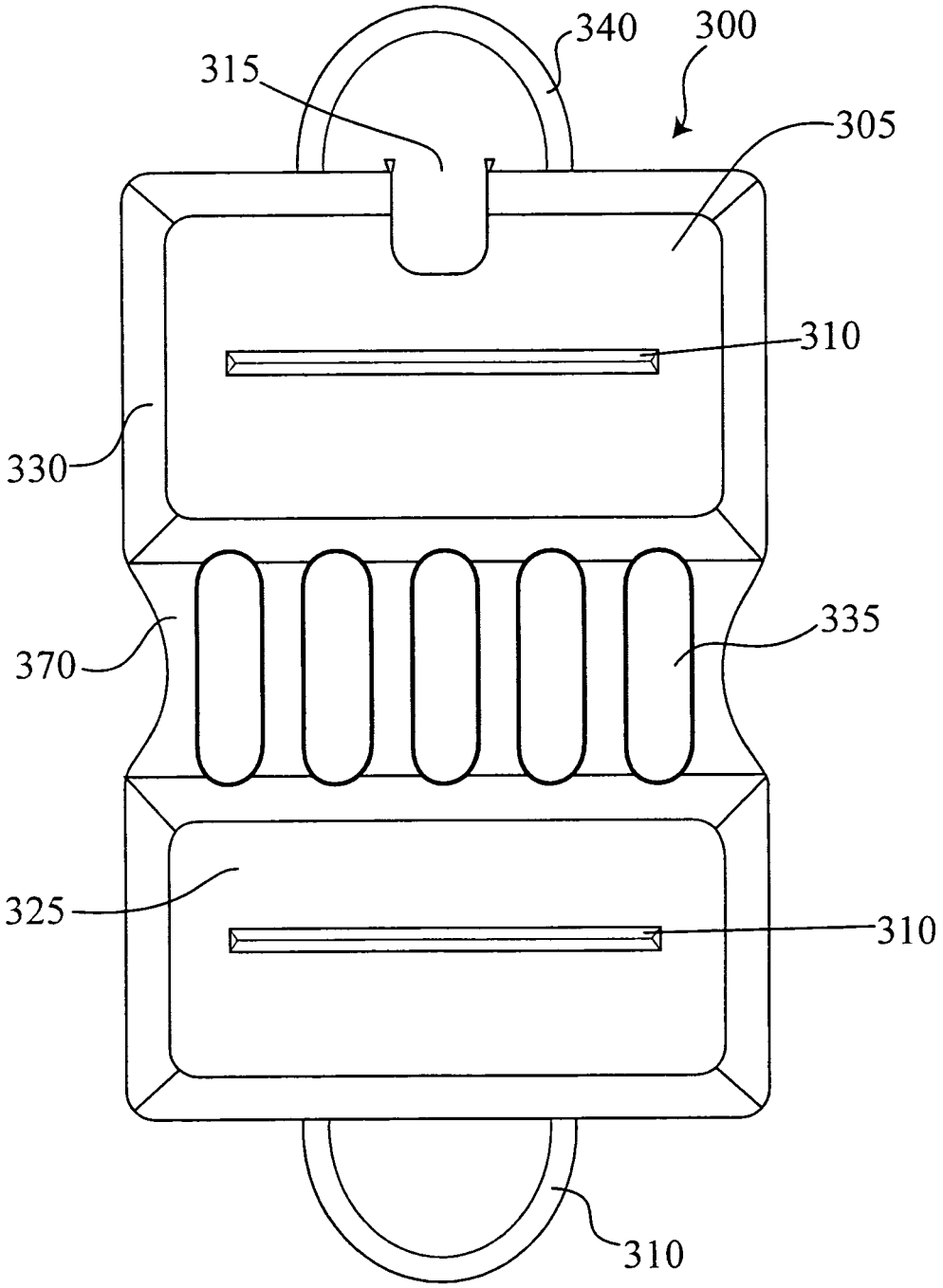
FIG. 4 is a cover having an alternative hanging element.

Another embodiment of the present invention is shown in FIG. 4. This embodiment of the cover 300 of the present invention has the same features as the embodiment shown in FIGS. 1-3, except the hanging element is configured as a ridge 310. The ridge 310 is attached to the inside surface 325 of at least one face 305 so that it engages an underside portion of the cement tool to prevent the cement tool from touching the bottom of the cover when placed on a surface. Like the embodiments shown in FIGS. 1-3, the embodiment shown in FIG. 4 can either be made from a single mold or in two pieces designed to come together as a single unit and can have sides 330.

The one-piece cover 300 shown in FIG. 4 further comprises drain slots 335 alternatively spaced between attachment pieces 370. This arrangement allows for proper drainage of a wet tool and is designed to hold the two halves of the one-piece embodiment together. The alternating drain slot 335 and attachment piece 370 performs as a hinge that allows the two halves of the device to come together as a single unit. The two halves of the cover can have side panels 330 that when closed define the thickness of the cover. The dimensions of the cover are configured to fit the most common sized cement finishing tools especially the overall length of the cover. That is, the length of the cover must be long enough to protect the fibers, especially the fiber ends, from contact and disfigurement.

Each halve of the cover can be equipped with a neck hole 315 opening designed to accommodate cement-finishing tools having a raised neck and can be stored with either the extension pole attached to the frame or not. The cover 300 can be equipped with a handle 340 for easy carrying. The outside surfaces can be inscribed with a company name or other logos as described above.

Figure 5:
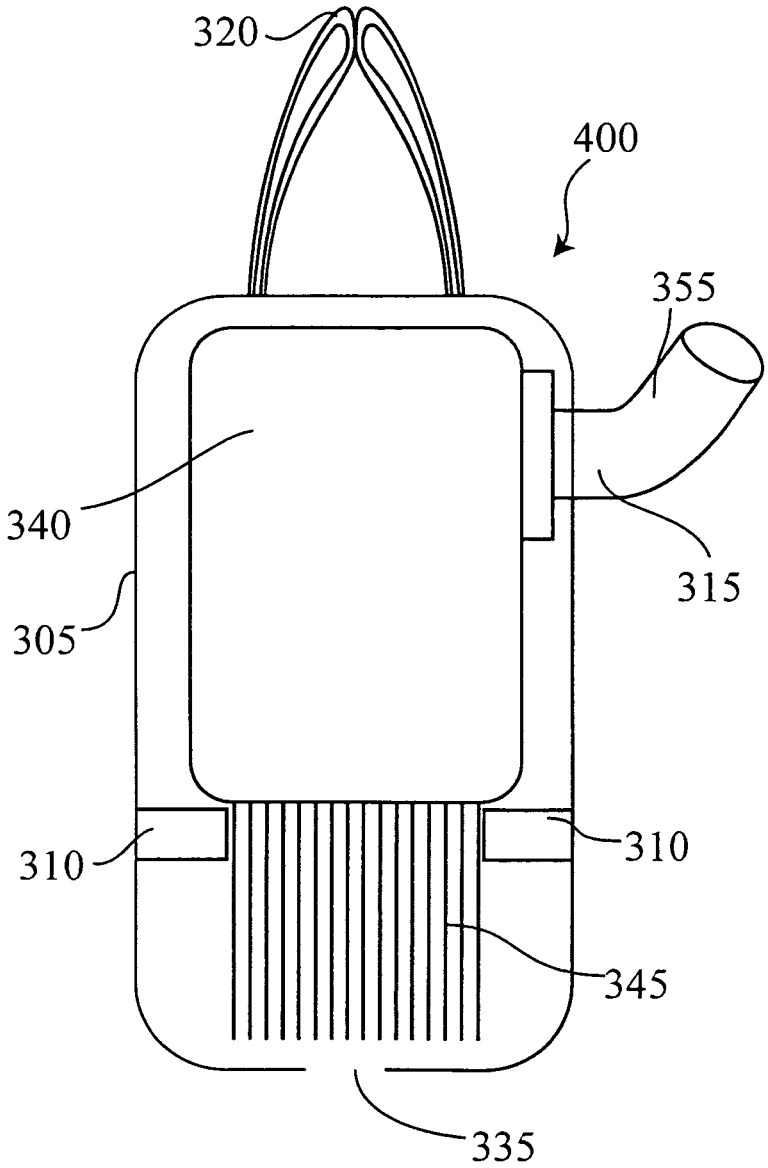
FIG. 5 is a partial cut away cross-sectional view of the tool hanging on the hanging elements in a closed position.

FIG. 5 is a partial cut away side cross sectional view 400 in which the two portions of the handle 320 are snapped together to close the cover. Positioned within the cover 400 is a tool having a frame 340 and fibers 345. The frame 340 is positioned to rest on hanging elements 310 to elevate the fibers 345 off of the bottom portion of the cover 400. The faces 305 protect the tool, especially the fibers 345 from damage. At the top of the cover 400 is an opening 315 designed to accommodate either the neck 355 of the frame 340 or an extension pole if attached. Finally, at the bottom of the cover are drain slots 335 that are designed to allow wet fibers to drain, dry and prevent mold. Additional vents can be provided in the faces of the cover in order to reduce mold and mildew.

Figure 6:
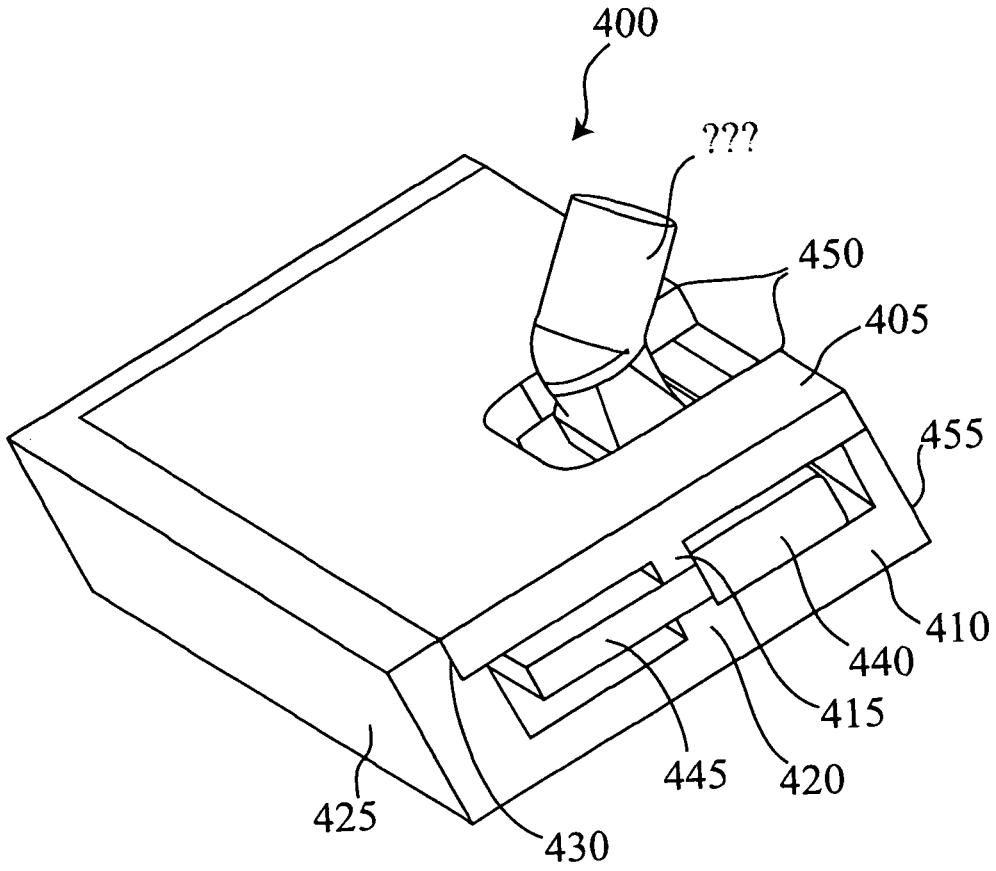
FIG. 6 is a partial cut away cross-sectional view of one embodiment of the present invention with the tool in a closed position.

FIG. 6 shows an alternative embodiment of the cover of the present invention 400. This embodiment has a first portion 405 having a ridge 415 on an inside face that is configured to engage at least a portion of the frame 440 of the cement finishing tool when in place therein. The first portion 405 has a cut out 450 that is configure to fit the neck of the cement finishing tool. The first portion 405 is designed to mate with a second portion 410 that is configured in a u-shape. The front face 425 of the second portion 410 is higher than rear face 455 of the second portion 410 and has a step 430 on the inside portion that is configured to accept the first portion 405 so that when placed together the first portion 405 fits in the step 430 of the second portion and forms an enclosure.

The second portion 410 also contains a ridge 420 designed to engage at least a portion of the frame 440 of the cement finishing tool so as to suspend the cement finishing tool in the cover and prevent the bundle of fibers 445 from protruding out of a bottom portion of the cover 400. This prevents the bundle of fibers 445 from contacting a surface when the cover 400 with the cement finishing tool is positioned in the cover is placed on a surface. This embodiment can have a handle (not shown) and a clasping element designed to keep the cover together once the cement finishing tool is enclosed in the cover.

The cover of the present invention can be made from plastic, metal, alloy, composite material Poly vinyl Chloride (PVC), alloys, wood, man-made materials, and combinations thereof. The processes used to make the cover of the present invention are well known in the art and include die casting, spin molding, pressure molding, simple assembly and other manufacturing procedures.

A kit including at least one cover and at least one cement finishing tool head along with instructions on how the cover can uses. The kit may also include additional replacement tools for the cement finishing tool either of the same or different sizes and shapes. These shapes and covers are configured to fit within the same cover or other sized covers can be provided.

Also provided is a method of storing the cement finishing tool using at least one of the cement finishing tool covers provided herein.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A system comprising:

a cement finishing tool having a bundle of fibers affixed to a frame at one end thereof, said frame comprising opposite front and back walls that are connected to one another by opposite side walls, said frame comprising an aperture that extends into said back wall without extending through said front wall, said aperture intersecting a longitudinal axis defined by at least one of said fibers; and a cement finishing tool cover comprising front and back substantially parallel spaced apart face panels that form an enclosure for said cement finishing tool, said front and back face panels having an inside surface and an outside surface, said inside surface of said back face panel comprising a projection defining a hanging element that is disposed in said aperture to suspend said cement finishing tool in said cover and prevent said fibers from protruding out of a bottom portion of said cover thereby preventing said fibers from contacting a floor when said cover with said cement finishing tool positioned in said cover is placed on said floor, the front and back panels are connected by a plurality of spaced apart attachment pieces that form a hinged portion at the bottom portion such that the cover is moveable between an open configuration to a closed configuration in which the front panel and back panel are parallel, the spaced apart attachment pieces form a plurality of drainage openings so as to allow liquid from said cement finishing tool to drain out of the cover.

2. The system of claim 1, wherein said cement finishing tool cover comprises a top, a bottom, a right side panel and a left side panel configured to contact said front and back face panels so as to form an enclosure for said cement finishing tool and wherein said projection extends substantially perpendicular to the inside surfaces thereby preventing said bundle of fibers from contacting said surface when said cover with said cement finishing tool positioned in said cover is placed on said floor.

3. The system of claim 1 wherein the frame comprises an extension extending from said back wall, said extension comprising a first portion extending transverse to said fibers and a second portion extending from the first portion, the second portion extending transverse to the first portion, the second portion comprising an opening configured to accommodate an elongated handle of said cement finishing tool.

4. The system of claim 1 further comprising at least one vent opening in at least one of said front and back face panels so as to facilitate drying of the cement finishing tool when it is wet.

5. The system of claim 1 wherein said cement finishing tool cover comprises a handle.

6. The system of claim 5, wherein the handle comprises a first portion disposed with the front face panel and a second portion disposed with the back face panel, the first and second portions engaging one another when the cover is closed.

7. A system as recited in claim 1, wherein:

the inside surface of the back face panel includes the projection;

a neck hole opening extends into a proximal end surface of the back face panel; and the back wall comprises a neck projecting outwardly therefrom, the neck extending through the neck hole opening.

8. A system as recited in claim 7, wherein the neck comprises an inner surface defining a channel configured for disposal of an extension pole.

9. A system as recited in claim 7, wherein the neck comprises a first portion extending outwardly from the back wall and a second portion that extends from the first portion at an acute angle relative to the first portion, the first and second portions each extending through the neck hole opening.

10. A system comprising;

a tool cover comprising a front face panel, a back face panel and a bottom panel connecting distal end surfaces of the front and back face panels, the bottom panel comprising a plurality of spaced apart attachment pieces that define drain slots therebetween, wherein inner surfaces of the front face panel, the back face panel and the bottom panel define a portion of an enclosure, the inner surface of one of the face panels comprising a projection extending therefrom defining a hanging element; and a cement finishing tool disposed in the enclosure and comprising a head including a frame and a bundle of fibers affixed to the frame, the frame comprising opposite front and back walls and an aperture extending into one of the front and back walls without extending through the other of the front and back walls, the projection being disposed in the aperture.

11. A system as recited in claim 10, wherein the bottom face panel defines a hinge portion configured to bend in a direction that is parallel with the distal end surfaces of the front and back face panels to move the tool cover between an open configuration and a closed configuration.

12. A system as recited in claim 11, wherein the front face panel, the bottom face panel and the bottom panel each lie in a first plane when the tool cover is in the open configuration and the bottom panel extends transverse to the front and back face panels when the tool cover is in the closed configuration.

13. A system as recited in claim 10, wherein the aperture intersects a longitudinal axis defined by at least one of the fibers.

14. A system as recited in claim 10, wherein:

a neck hole opening extends into a proximal end surface of the back face panel opposite the distal end surface of the back face panel; and the aperture extends into the back wall, and the back wall comprises a neck projecting outwardly therefrom, the neck extending through the neck hole opening.

15. A system as recited in claim 14, wherein the neck comprises an inner surface defining a channel configured for disposal of an extension pole.

16. A system as recited in claim 14, wherein the neck comprises a first portion extending perpendicular to the fibers and a second portion that extends at an acute angle relative to the first portion, the first and second portions each extending through the neck hole opening.

17. A system as recited in claim 10, wherein the drainage slots each extend perpendicular to the distal end surfaces of the front and back face panels.

18. A system comprising:

a tool cover comprising a front face panel, a back face panel opposite the front face panel and a bottom panel connecting distal end surfaces of the front and back face panels, the bottom panel comprising a plurality of spaced apart attachment pieces that define drain slots therebetween, wherein inner surfaces of the front face panel, the back face panel and the bottom panel define an enclosure, the inner surfaces of the front and back face panels each comprise a projection extending therefrom defining a hanging element, a neck hole opening extends into a proximal end surface of the back face panel opposite the distal end surface of the back face panel; and a cement finishing tool disposed in the enclosure and comprising a head including a frame having a bundle of fibers affixed thereto, the frame comprising a first aperture extending into a back wall of the frame without extending through an opposite front wall of the frame and a second aperture that extends into the front wall without extending through the back wall, the apertures each intersecting a longitudinal axis defined by at least one of the fibers, the projections being disposed in the apertures, wherein the front and back walls are connected to one another by opposite side walls, the back wall comprising a neck projecting outwardly therefrom, the neck extending through the neck hole opening, the neck comprising a first portion extending transverse to the fibers and a second portion that extends at an acute angle relative to the first portion, the first and second portions each extending through the neck hole opening, the second portion comprising an inner surface defining a channel configured for disposal of an extension pole, wherein the bottom panel defines a hinge portion configured to bend in a direction that is parallel with the distal end surfaces of the front and back face panels to move the tool cover between an open configuration and a closed configuration, wherein the front face panel, the bottom face panel and the bottom panel each lie in a first plane when the tool cover is in the open configuration and the bottom panel extends transverse to the front and back face panels when the tool cover is in the closed configuration.

19. The system of claim 1, wherein said frame comprises a second aperture that extends into said back panel without extending through said front panel and said cement finishing tool comprises a second projection extending from said inside surface of said front panel, said second projection being disposed in said second aperture.

20. A system as recited in claim 10, wherein:

the aperture extends into the back wall without extending through the front wall and the projection extends from the inner surface of the back face panel; and the frame comprises a second aperture that extends into the front panel without extending through the back panel and the cement finishing tool cover comprises a second projection extending from the inner surface of the front face panel, the second projection being disposed in the second aperture.

* * * * *